US012371818B2

(12) United States Patent
Qiu

(10) Patent No.: US 12,371,818 B2
(45) Date of Patent: Jul. 29, 2025

(54) FULLY-DEGRADABLE COMPOSITE FILAMENT AND MANUFACTURING METHOD AND APPLICATION THEREOF

(71) Applicant: GUANGDONG XINQIU NEW MATERIAL TECHNOLOGY CO., LTD, Heyuan (CN)

(72) Inventor: Xianjun Qiu, Heyuan (CN)

(73) Assignee: GUANGDONG XINQIU NEW MATERIAL TECHNOLOGY CO., LTD, Heyuan (CN)

( * ) Notice: Subject to any disclaimer, the term of this patent is extended or adjusted under 35 U.S.C. 154(b) by 0 days.

(21) Appl. No.: 18/250,426

(22) PCT Filed: Mar. 16, 2023

(86) PCT No.: PCT/CN2023/081788
§ 371 (c)(1),
(2) Date: Apr. 25, 2023

(87) PCT Pub. No.: WO2023/138707
PCT Pub. Date: Jul. 27, 2023

(65) Prior Publication Data

US 2025/0075378 A1 Mar. 6, 2025

(30) Foreign Application Priority Data

Jan. 24, 2022 (CN) ..... 202210077520.7

(51) Int. Cl.
*D01F 8/14* (2006.01)
*D01D 5/34* (2006.01)

(52) U.S. Cl.
CPC ..... *D01F 8/14* (2013.01); *D01D 5/34* (2013.01); *D10B 2331/041* (2013.01); *D10B 2401/04* (2013.01); *D10B 2401/12* (2013.01)

(58) Field of Classification Search
CPC ..... D01F 8/14
See application file for complete search history.

(56) References Cited

U.S. PATENT DOCUMENTS

2009/0131181 A1 5/2009 Brace et al.
2014/0120346 A1 5/2014 Rochen
2019/0352999 A1 11/2019 Greenlee et al.

FOREIGN PATENT DOCUMENTS

CN 101805941 Y 8/2010
CN 106232882 12/2016
(Continued)

OTHER PUBLICATIONS

English Language Translation of JP2003342836, published Dec. 3, 2003. (Year: 2003).*
ISR of PCT/CN2023/081788, Published Jun. 25, 2023.

*Primary Examiner* — Andrew T Piziali

(57) ABSTRACT

The present invention discloses a fully-degradable composite filament and a manufacturing method and application thereof and relates to the technical field of fiber preparation. The fully-degradable composite filament comprises an outer surface layer and an inner core layer. The outer surface layer clads the surface of the inner core layer, the inner core layer has a hollow tubular structure, the inner core layer is single-layer fibers made of a high-melting-point polylactic acid fiber material, and the outer surface layer is single-layer fibers made of a low-melting-point polylactic acid fiber material; and the melting point of the inner core layer is higher than that of the outer surface layer. In the present invention, the composite filament is composed of a surface layer (low-melting-point PLA)+a core (high-melting-point PLA), and the technical purpose of the complete degradation function of the composite filament is achieved using the degradability of PLA.

6 Claims, 2 Drawing Sheets

(56) References Cited

FOREIGN PATENT DOCUMENTS

| | | | | | |
|---|---|---|---|---|---|
| CN | 106232882 | Y | | 12/2016 | |
| CN | 106702510 | Y | | 5/2017 | |
| CN | 108468102 | Y | | 8/2018 | |
| CN | 109629080 | Y | | 4/2019 | |
| CN | 109853081 | Y | | 6/2019 | |
| CN | 114182391 | | | 3/2022 | |
| CN | 114395810 | | | 4/2022 | |
| JP | 2003342836 | | | 12/2003 | |
| WO | WO-2015164447 | A2 | * | 10/2015 | ..... A24D 3/065 |

* cited by examiner

FULLY-DEGRADABLE COMPOSITE FILAMENT AND MANUFACTURING METHOD AND APPLICATION THEREOF

TECHNICAL FIELD

The present invention relates to the technical field of fiber preparation, and particularly relates to a fully-degradable composite filament and a manufacturing method and application thereof.

BACKGROUND

The existing absorbent fiber stick is formed by compounding single fibers of a pure PET (polyester) or PP (polypropylene) material, and these fibers, as an absorbent core, are bonded by glue or compounded by heat melt so that the fibers are tightly bonded to form a rod-like structure with certain elasticity.

The above prior art has the following problem: the PET (polyester) or PP (polypropylene) material does not has the function of degradation and thus is not suitable for the exiting requirements of environmental protection.

SUMMARY

The purpose of the present invention is to provide a fully-degradable composite filament and a manufacturing method and application thereof, so as to solve the problem in the above prior art and enable the composite filament to have the function of complete degradation.

To achieve the above purpose, the present invention provides the following solution: the present invention provides a fully-degradable composite filament, comprising an outer surface layer and an inner core layer, wherein the outer surface layer clads the surface of the inner core layer, the inner core layer has a hollow tubular structure, the inner core layer is single-layer fibers made of a high-melting-point polylactic acid fiber material, and the outer surface layer is single-layer fibers made of a low-melting-point polylactic acid fiber material; and the melting point of the inner core layer is higher than that of the outer surface layer.

Preferably, the melting point of the low-melting-point polylactic acid fiber material is 150-160° C., and the melting point of the high-melting-point polylactic acid fiber material is 185-209° C.

Preferably, the component of the outer surface layer accounts for 40%-60% of the total amount, and the component of the inner core layer accounts for 60%-40% of the total amount.

Preferably, the size range of each composite filament is 3D-12D.

The present invention also provides a manufacturing method for a fully-degradable composite filament, comprising the following steps:

Step 1: manufacturing single-layer fibers of the hollow inner core layer, and drying poly-L-lactic acid (PLLA) slices and poly-D-lactic acid (PDLA) slices in vacuum under the conditions of drying time of 12-48 h, drying temperature of 60-140° C. and vacuum degree less than 1000 Pa, wherein the water content of the dried slices is less than 100 ppm; mixing the dried PLLA slices and PDLA slices at a weight ratio of 20:80-80:20, and adding a nucleating agent accounting for 0.01 wt %-5 wt % of the total weight of the PLA slices for full mixing, wherein the nucleating agent is a composition of organophosphate metal salt and hydrotalcite at a weight ratio of 1:1, and the metal is one of aluminum, magnesium, calcium and iron; and feeding the mixed material into a twin-screw spinning machine for melt blending at 160-245° C., ejecting the blending melt through a spinneret plate, conducting air blast cooling and oiling, and then winding up into as-formed fibers;

Step 2: manufacturing a composite filament, making the low-melting-point polylactic acid fiber material react in a melting chamber at a temperature of 175° C., conducting deslagging and acid-base neutralization, drawing the single-layer fibers of the hollow inner core layer into the melting chamber, filling high-pressure inert gas into the melting chamber, attaching the low-melting-point polylactic acid fiber material in the molten state to the outer surface of the single-layer fibers of the hollow inner core layer in a high-pressure environment to form a composite filament with a double-layer structure, and cooling the composite filament during the drawing process to pull the composite filament to the required length and diameter;

Step 3: elasticizing the composite filament by an elasticizer so as to allow the fibers to form DTY fibers with preferable porosity and bulkiness.

The present invention also provides application of the fully-degradable composite filament in manufacturing of fiber nibs, absorbent sticks and absorbent sticks.

Compared with the prior art, the present invention has the following technical effects:

In the present invention, the composite filament is composed of a surface layer (low-melting-point PLA)+a core (high-melting-point PLA), and the technical purpose of the complete degradation function of the composite filament is achieved using the degradability of PLA.

DESCRIPTION OF DRAWINGS

To more clearly describe the technical solutions in the embodiments of the present invention or in prior art, the drawings required to be used in the embodiments will be simply presented below. Apparently, the drawings in the following description are merely some embodiments of the present invention, and for those skilled in the art, other drawings can also be obtained according to these drawings without contributing creative labor.

In the figures, 1—outer surface layer; and 2—inner core layer.

DETAILED DESCRIPTION

The technical solutions in the embodiments of the present invention will be clearly and fully described below in combination with the drawings in the embodiments of the present invention. Apparently, the described embodiments are merely part of the embodiments of the present invention, not all of the embodiments. Based on the embodiments in the present invention, all other embodiments obtained by those ordinary skilled in the art without contributing creative labor will belong to the protection scope of the present invention.

To make the above-mentioned purpose, features and advantages of the present invention more clear and understandable, the present invention will be further described below in detail in combination with the drawings and specific embodiments.

Figure 1:
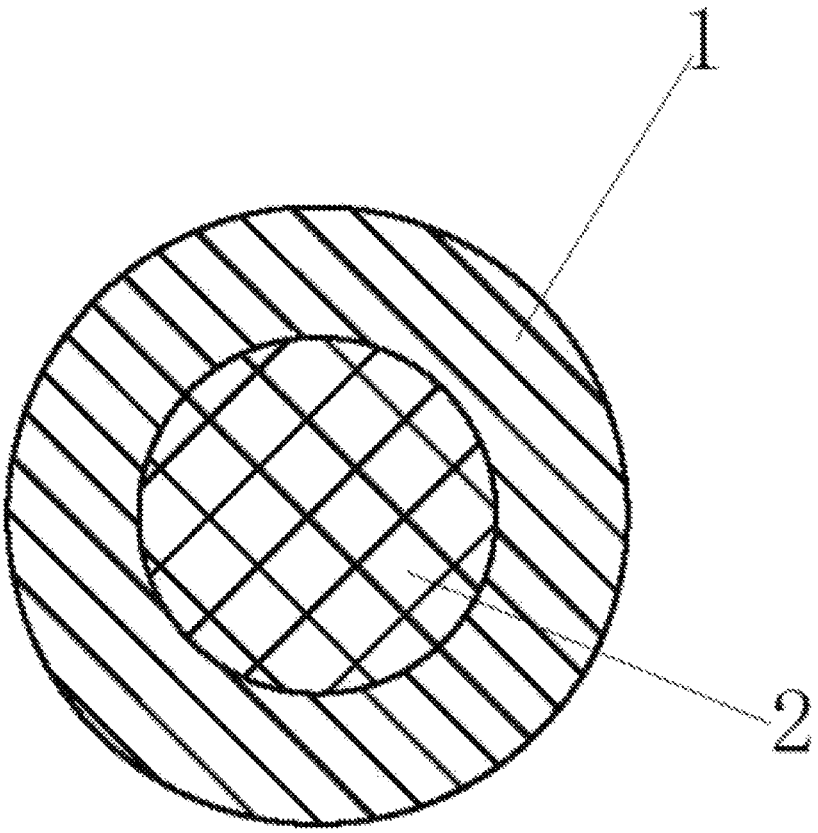
FIG. 1 is a structural schematic diagram of a composite filament of the present invention.
Figure 2:
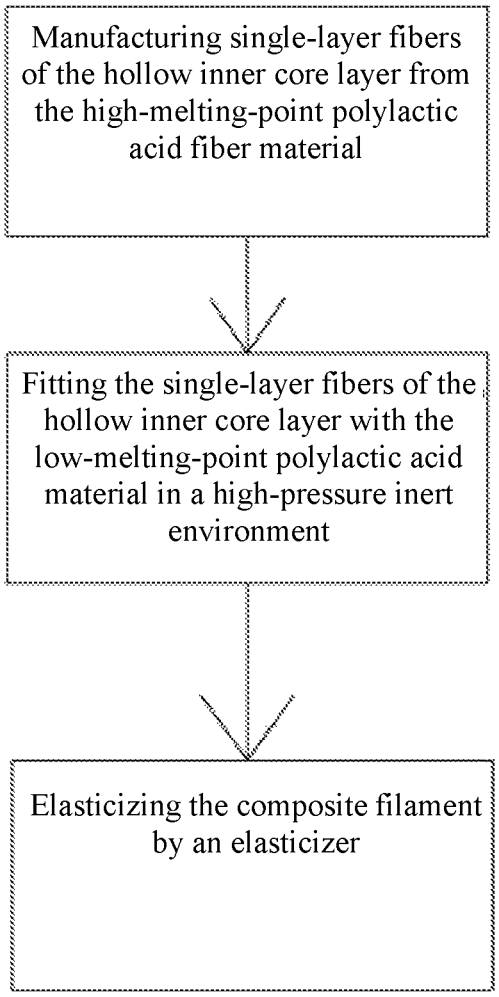
FIG. 2 is a flow chart of preparation of the present invention.

As shown in FIG. 1, the present invention provides a fully-degradable composite filament, comprising an outer surface layer 1 and an inner core layer 2, wherein the outer surface layer 1 clads the surface of the inner core layer, the inner core layer 2 has a hollow tubular structure, the inner core layer 2 is single-layer fibers made of a high-melting-point polylactic acid fiber material, and the outer surface layer 1 is single-layer fibers made of a low-melting-point polylactic acid fiber material; and the melting point of the inner core layer 2 is higher than that of the outer surface layer 1. That is, the composite filament is composed of a surface layer (low-melting-point PLA)+a core (high-melting-point PLA), and the technical purpose of the complete degradation function of the composite filament is achieved using the degradability of PLA. Compared with the PET (polyester) or PP (polypropylene) material in the prior art, the composite filament in the present invention has great advantages.

To ensure the effective application of the composite filament in the subsequent process of preparing fiber sticks, in the present invention, the melting point of the low-melting-point polylactic acid fiber material is 150-160° C., and the melting point of the high-melting-point polylactic acid fiber material is 185-209° C.

To ensure that the composite filament can have better formability and water absorption after forming in the subsequent process of preparing fiber sticks, in the present invention, the component of the outer surface layer 1 accounts for 40%-60% of the total amount, and the component of the inner core layer 2 accounts for 60%-40% of the total amount.

In the present invention, the size range of each composite filament is 3D-12D.

The present invention also provides a manufacturing method for a fully-degradable composite filament, comprising the following steps:

Step 1: manufacturing single-layer fibers of the hollow inner core layer, and drying poly-L-lactic acid (PLLA) slices and poly-D-lactic acid (PDLA) slices in vacuum under the conditions of drying time of 12-48 h, drying temperature of 60-140° C. and vacuum degree less than 1000 Pa, wherein the water content of the dried slices is less than 100 ppm; mixing the dried PLLA slices and PDLA slices at a weight ratio of 20:80-80:20, and adding a nucleating agent accounting for 0.01 wt %-5 wt % of the total weight of the PLA slices for full mixing, wherein the nucleating agent is a composition of organophosphate metal salt and hydrotalcite at a weight ratio of 1:1, and the metal is one of aluminum, magnesium, calcium and iron; and feeding the mixed material into a twin-screw spinning machine for melt blending at 160-245° C., ejecting the blending melt through a spinneret plate, conducting air blast cooling and oiling, and then winding up into as-formed fibers; wherein the organophosphate metal salt is aryl phosphate hydroxy-aluminum salt;

Step 2: manufacturing a composite filament, making the low-melting-point polylactic acid fiber material react in a melting chamber at a temperature of 175° C., conducting deslagging and acid-base neutralization, drawing the single-layer fibers of the hollow inner core layer into the melting chamber, filling high-pressure inert gas into the melting chamber, attaching the low-melting-point polylactic acid fiber material in the molten state to the outer surface of the single-layer fibers of the hollow inner core layer in a high-pressure environment to form a composite filament with a double-layer structure, and cooling the composite filament during the drawing process to pull the composite filament to the required length and diameter;

Step 3: elasticizing the composite filament by an elasticizer so as to allow the fibers to form DTY fibers with preferable porosity and bulkiness.

The present invention also provides application of the fully-degradable composite filament in manufacturing of fiber nibs, absorbent sticks and absorbent sticks.

Adaptive changes made according to actual needs are within the protection scope of the present invention.

It should be noted that for those skilled in the art, apparently, the present invention is not limited to details of the above demonstrative embodiments. Moreover, the present invention can be realized in other specific forms without departing from the spirit or basic feature of the present invention. Therefore, in all respects, the embodiments shall be regarded to be demonstrative and nonrestrictive. The scope of the present invention is defined by appended claims, rather than the above description. Therefore, the present invention is intended to include all changes falling into the meaning and the scope of equivalent elements of claims within the present invention. Any drawing mark in claims shall not be regarded to limit the concerned claims.

Specific individual cases are applied in the present invention for elaborating the principle and embodiments of the present invention. The illustration of the above embodiments is merely used for helping to understand the method and the core thought of the present invention. Meanwhile, for those ordinary skilled in the art, specific embodiments and the application scope may be changed in accordance with the thought of the present invention. In conclusion, the contents of the description shall not be interpreted as a limitation to the present invention.

The invention claimed is:

1. A fully-degradable composite filament, comprising an outer surface layer and an inner core layer, wherein the outer surface layer clads the surface of the inner core layer, the inner core layer has a hollow tubular structure, the inner core layer is single-layer fibers made of a high-melting-point polylactic acid fiber material, and the outer surface layer is single-layer fibers made of a low-melting-point polylactic acid fiber material; and the melting point of the inner core layer is higher than that of the outer surface layer.

2. The fully-degradable composite filament according to claim 1, wherein the melting point of the low-melting-point polylactic acid fiber material is 150-160° C., and the melting point of the high-melting-point polylactic acid fiber material is 185-209° C.

3. The fully-degradable composite filament according to claim 1, wherein the component of the outer surface layer accounts for 40%-60% of the total amount, and the component of the inner core layer accounts for 60%-40% of the total amount.

4. The fully-degradable composite filament according to claim 1, wherein the size range of each composite filament is 3D-12D.

5. A manufacturing method for the fully-degradable composite filament of claim 1, comprising the following steps:

step 1: manufacturing single-layer fibers of the hollow inner core layer, and drying poly-L-lactic acid (PLLA) slices and poly-D-lactic acid (PDLA) slices in vacuum under the conditions of drying time of 12-48 h, drying temperature of 60-140° C. and vacuum degree less than 1000 Pa, wherein the water content of the dried slices is less than 100 ppm; mixing the dried PLLA slices and PDLA slices at a weight ratio of 20:80-80:20, and adding a nucleating agent accounting for 0.01 wt %-5 wt % of the total weight of the PLA slices for full mixing, wherein the nucleating agent is a composition of organophosphate metal salt and hydrotalcite at a weight ratio of 1:1, and the metal is one of aluminum, magnesium, calcium and iron; and feeding the mixed material into a twin-screw spinning machine for melt blending at 160-245° C., ejecting the blending melt through a spinneret plate, conducting air blast cooling and oiling, and then winding up into as-formed fibers;

step 2: manufacturing a composite filament, making the low-melting-point polylactic acid fiber material react in a melting chamber at a temperature of 175° C., conducting deslagging and acid-base neutralization, drawing the single-layer fibers of the hollow inner core layer into the melting chamber, filling high-pressure inert gas into the melting chamber, attaching the low-melting-point polylactic acid fiber material in the molten state to the outer surface of the single-layer fibers of the hollow inner core layer in a high-pressure environment to form a composite filament with a double-layer structure, and cooling the composite filament during the drawing process to pull the composite filament to the required length and diameter;

step 3: elasticizing the composite filament by an elasticizer so as to allow the fibers to form DTY fibers with preferable porosity and bulkiness.

6. Application of the fully-degradable composite filament of claim 1 in manufacturing of fiber nibs, absorbent sticks and absorbent sticks.

* * * * *